US008761422B2

(12) United States Patent
Fitz et al.

(10) Patent No.: US 8,761,422 B2
(45) **Date of Patent: *Jun. 24, 2014**

(54) FREQUENCY TRANSLATION BY HIGH-FREQUENCY SPECTRAL ENVELOPE WARPING IN HEARING ASSISTANCE DEVICES

(75) Inventors: Kelly Fitz, Eden Prairie, MN (US); Brent Edwards, San Francisco, CA (US); Deniz Baskent, Berkeley, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 35 days.

This patent is subject to a terminal disclaimer.

(21) Appl. No.: 13/208,023

(22) Filed: Aug. 11, 2011

(65) Prior Publication Data

US 2012/0177236 A1 Jul. 12, 2012

Related U.S. Application Data

(63) Continuation of application No. 12/043,827, filed on Mar. 6, 2008, now Pat. No. 8,000,487.

(51) Int. Cl.
*H04R 25/00* (2006.01)

(52) U.S. Cl.
USPC ..... 381/316; 381/312; 381/320

(58) Field of Classification Search
USPC ..... 381/312, 316, 320
See application file for complete search history.

(56) References Cited

U.S. PATENT DOCUMENTS

| | | | |
|---|---|---|---|
| 5,014,319 | A | 5/1991 | Leibman |
| 5,771,299 | A | 6/1998 | Melanson |
| 6,169,813 | B1 | 1/2001 | Richardson et al. |
| 6,577,739 | B1 | 6/2003 | Hurtig et al. |
| 6,980,665 | B2 | 12/2005 | Kates |
| 7,580,536 | B2 | 8/2009 | Carlile et al. |
| 8,000,487 | B2 | 8/2011 | Fitz et al. |
| 8,526,650 | B2 | 9/2013 | Fitz |
| 2004/0264721 | A1 | 12/2004 | Allegro et al. |
| 2006/0247922 | A1 | 11/2006 | Hetherington et al. |
| 2006/0253209 | A1 | 11/2006 | Hersbach et al. |
| 2008/0215330 | A1 | 9/2008 | Harma et al. |
| 2009/0226016 | A1 | 9/2009 | Fitz |
| 2010/0284557 | A1 | 11/2010 | Fitz |

FOREIGN PATENT DOCUMENTS

| | | | |
|---|---|---|---|
| WO | WO-0076920 | A1 | 12/2000 |
| WO | WO-2007010479 | A2 | 1/2007 |
| WO | WO-2007135198 | A2 | 11/2007 |

OTHER PUBLICATIONS

"U.S. Appl. No. 12/043,827, Notice of Allowance mailed Jun. 10, 2011", 6 pgs.
"European Application Serial No. 09250638.5, Extended Search Report mailed Jan. 20, 2012", 8 pgs.

(Continued)

*Primary Examiner* — Suhan Ni
(74) *Attorney, Agent, or Firm* — Schwegman, Lundberg & Woessner, P.A.

(57) ABSTRACT

Disclosed herein, among other things, is a system for frequency translation by high-frequency spectral envelope warping in hearing assistance devices. The present subject matter relates to improved speech intelligibility in a hearing assistance device using frequency translation by high-frequency spectral envelope warping. The system described herein implements an algorithm for performing frequency translation in an audio signal processing device for the purpose of improving perceived sound quality and speech intelligibility in an audio signal when presented using a system having reduced bandwidth relative to the original signal, or when presented to a hearing-impaired listener sensitive to only a reduced range of acoustic frequencies.

20 Claims, 10 Drawing Sheets

(56) References Cited

OTHER PUBLICATIONS

"European Application Serial No. 10250883.5, Office Action mailed Jan. 23, 2012", 8 pgs.
Hermansen, K., et al., "Hearing aids for profoundly deaf people based on a new parametric concept", Applications of Signal Processing to Audio and Acoustics, 1993; Final Program and Paper Summaries, 1993, IEEE Workshop on,, vol., Iss. Oct. 17-20, 1993, 89-92.
Kuk, F., et al., "Linear Frequency Transposition: Extending the Audibility of High-Frequency Information", Hearing Review, (Oct. 2006), 5 pages.
Makhoul, John, "Linear Prediction: A Tutorial Review", Proceedings of the IEEE, 63, (Apr. 1975), 561-580.
McDermott, H., et al., "Preliminary results with the AVR ImpaCt frequency-transposing hearing aid", J Am Acad Audiol, vol. 12, (2001), pp. 121-127.
McDermottt, H., et al., "Improvements in speech perception with use of the AVR TranSonic frequency-transposing hearing aid.", Journal of Speech, Language, and Hearing Research, vol. 42, (Dec. 1999), pp. 1323-1335.
McLoughlin, Ian Vince, et al., "Line spectral pairs", Signal Processing, Elsevier Science Publisher B.V. Amsterdam, NL, vol. 88, No. 3, (Nov. 14, 2007), 448-467.
Sekimoto, Sotaro, et al., "Frequency Compression Techniques of Speech Using Linear Prediction Analysis-Synthesis Scheme", Ann Bull RILP, vol. 13, (Jan. 1, 1979), 133-136.
Simpson, A., et al., "Improvements in speech perception with an experimental nonlinear frequency compression hearing device", Int J Audiol., vol. 44(5), (May 2005), 281-292.
Turner, C. W., et al., "Proportional frequency compression of speech for listeners with sensorineutral hearing loss", J Acoust Soc Am., vol. 106(2), (Aug. 1999), 877-86.
"U.S. Appl. No. 12/774,356, Non Final Office Action mailed Aug. 16, 2012", 6 pgs.
"U.S. Appl. No. 12/774,356, Notice of Allowance mailed Jan. 8, 2013", 5 pgs.
"U.S. Appl. No. 12/774,356, Notice of Allowance mailed May 1, 2013", 6 pgs.
"U.S. Appl. No. 12/774,356, Response filed Dec. 17, 2012 to Non Final Office Action mailed Aug. 16, 2012", 8 pgs.
"European Application Serial No. 09250638.5, Response filed Aug. 22, 2012 to Extended Search Report mailed Jan. 20, 2012", 16 pgs.
"European Application Serial No. 10250883.5, Response filed Aug. 22, 2012 to Extended European Search Report mailed Jan. 23, 2012", 16 pgs.

FREQUENCY TRANSLATION BY HIGH-FREQUENCY SPECTRAL ENVELOPE WARPING IN HEARING ASSISTANCE DEVICES

RELATED APPLICATION

This application is a continuation of and claims the benefit of priority under 35 U.S.C. §120 to U.S. patent application Ser. No. 12/043,827, filed on Mar. 6, 2008, which is incorporated herein by reference in its entirety.

TECHNICAL FIELD

This disclosure relates generally to hearing assistance devices, and more particularly to frequency translation by high-frequency spectral envelope warping in hearing assistance devices.

BACKGROUND

Hearing assistance devices, such as hearing aids, include, but are not limited to, devices for use in the ear, in the ear canal, completely in the canal, and behind the ear. Such devices have been developed to ameliorate the effects of hearing losses in individuals. Hearing deficiencies can range from deafness to hearing losses where the individual has impairment responding to different frequencies of sound or to being able to differentiate sounds occurring simultaneously. The hearing assistance device in its most elementary form usually provides for auditory correction through the amplification and filtering of sound provided in the environment with the intent that the individual hears better than without the amplification.

In order for the individual to benefit from amplification and filtering, they must have residual hearing in the frequency regions where the amplification will occur. If they have lost all hearing in those regions, then amplification and filtering will not benefit the patient at those frequencies, and they will be unable to receive speech cues that occur in those frequency regions. Frequency translation processing recodes high-frequency sounds at lower frequencies where the individual's hearing loss is less severe, allowing them to receive auditory cues that cannot be made audible by amplification.

One way of enhancing hearing for a hearing impaired person was proposed by Hermansen, Fink, and Hartmann in 1993. "Hearing Aids for Profoundly Deaf People Based on a New Parametric Concept," Hermansen, K.; Fink, F. K.; Hartmann, U; Hansen, V. M., *Applications of Signal Processing to Audio and Acoustics,* 1993. "Final Program and Paper Summaries," 1993 IEEE Workshop on, Vol., Iss, 17-20 October 1993, pp. 89-92. They proposed that a vocal tract (formant) model be constructed by linear predictive analysis of the speech signal and decomposition of the prediction filter coefficients into formant parameters (frequency, magnitude, and bandwidth). A speech signal was synthesized by filtering the linear prediction residual with a vocal tract model that was modified so that any high frequency formants outside of the range of hearing of a hearing impaired person were transposed to lower frequencies at which they can be heard. They also suggested that formants in low-frequency regions may not be transposed. However, this approach is limited in the amount of transposition that can be performed without distorting the low frequency portion of the spectrum (e.g., containing the first two formants). Since the entire signal is represented by a formant model, and resynthesized from the modified (transposed) formant model, the entire signal may be considerably altered in the process, especially when large transposition factors are used for patients having severe hearing loss at mid and high frequencies. In such cases, even the part of the signal that was originally audible to the patient is significantly distorted by the transposition process.

In U.S. Pat. No. 5,571,299, Melanson presented an extension to the work of Hermansen et. al. in which the prediction filter is modified directly to warp the spectral envelope, thereby avoiding the computationally expensive process of converting the filter coefficients into formant parameters. Allpass filters are inserted between stages in a lattice implementation of the prediction filter, and the fractional-sample delays introduced by the allpass filters determine the nature of the warping that is applied to the spectral envelope. One drawback of this approach is that it does not provide direct and complete control over the shape of the warping function, or the relationship between input frequency and transposed output frequency. Only certain input-output frequency relationships are available using this method.

In U.S. Pat. No. 5,014,319, Leibman relates a frequency transposition hearing aid that classifies incoming sound according to frequency content, and selects an appropriate transposition factor on the basis of that classification. The transposition is implemented using a variable-rate playback mechanism (the sound is played back at a slower rate to transpose to lower frequencies) in conjunction with a selective discard algorithm to minimize loss of information while keeping latency low. This scheme was implemented in the AVR TranSonic™ and ImpaCt™ hearing aids. However, in at least one study, this variable-rate playback approach has been shown to lack effectiveness in increasing speech intelligibility. See, for example, "Preliminary results with the AVR ImpaCt Frequency-Transposing Hearing Aid," McDermott, H. J.; Knight, M. R.; *J. Am. Acad. Audiol.,* 2001 March; 12 (3); 121-7 11316049 (P, S, E, B), and "Improvements in Speech Perception with use of the AVR TranSonic Frequency-Transposing Hearing Aid," McDermot, H. J.; Dorkos, V. P.; Dean, M. R.; Ching, T. Y.; *J. Speech Lang. Hear. Res.* 1999 December; 42(6):1323-35. Some disadvantages of this approach are that the entire spectrum of the signal is transposed, and that the pitch of the signal is, therefore, altered. To address this deficiency, this method uses a switching system that enables transposition when the spectrum is dominated by high-frequency energy, as during consonants. This switching system may introduce errors, especially in noisy or complex audio environments, and may disable transposition for some signals which could benefit from it.

In U.S. Patent Application Publication 2004 0264721 (issued as U.S. Pat. No. 7,248,711), Allegro et. al. relate a method for frequency transposition in a hearing aid in which a nonlinear frequency transposition function is applied to the spectrum. In contrast to Leibman, this algorithm does not involve any classification or switching, but instead transposes low frequencies weakly and linearly and high frequencies more strongly. One drawback of this method is that it may introduce distortion when transposing pitched signals having significant energy at high frequencies. Due to the nonlinear nature of the transposition function (the input-output frequency relationship), transposed harmonic structures become inharmonic. This artifact is especially noticeable when the inharmonic transposed signal overlaps the spectrum of the non-transposed harmonic structure at lower frequencies.

The Allegro algorithm is described as a frequency domain algorithm, and resynthesis may be performed using a vocoder-like algorithm, or by inverse Fourier transform. Frequency domain transposition algorithms (in which the transposition processing is applied to the Fourier transform of the input signal) are the most-often cited in the patent and scholarly literature (see for example Simpson et. al., 2005, and Turner and Hurtig, 1999, U.S. Pat. No. 6,577,739, U.S. Patent Application Publication 2004 0264721 (issued as U.S. Pat. No. 7,248,711) and PCT Patent Application WO 0075920). "Improvements in speech perception with an experimental nonlinear frequency compression hearing device," Simpson, A.; Hersbach, A. A.; McDermott, H. J.; *Int J Audiol.* 2005 May;44(5):281-92; and "Proportional frequency compression of speech for listeners with sensorineural hearing loss," Turner, C. W.; Hurtig, R. R.; *J Acoust Soc Am.* 1999 August; 106(2):877-86. Not all of these method render transposed harmonic structure inharmonic, but they all share the drawback that the pitch of transposed harmonic signals are altered.

Kuk et. al. (2006) discuss a frequency transposition algorithm implemented in the Widex Inteo hearing aid, in which energy in the one-octave neighborhood of the highest-energy peak above a threshold frequency is transposed downward by one or two octaves (a factor of two or four) and mixed with the original unprocessed signal. "Linear Frequency Transposition: Extending the Audibility of High-Frequency Information," Francis Kuk; Petri Korhonen; Heidi Peeters,; Denise Keenan; Anders Jessen; and Henning Andersen; *Hearing Review* 2006 October. As in other frequency domain methods, one drawback of this approach is that high frequencies are transposed into lower frequencies, resulting in unnatural pitch transpositions of the sound. Additional artifacts are introduced when the harmonic structure of the transposed signal overlaps the spectrum of the non-transposed harmonic structure at lower frequencies.

Therefore, an improved system for improved intelligibility without a degradation in natural sound quality in hearing assistance devices is needed.

SUMMARY

Disclosed herein, among other things, is a system for frequency translation by high-frequency spectral envelope warping in a hearing assistance device for a wearer. According to various embodiments, the present subject matter includes a method for processing an audio signal received by a hearing assistance device, including: filtering the audio signal to generate a high frequency filtered signal, the filtering performed at a splitting frequency; transposing at least a portion of an audio spectrum of the filtered signal to a lower frequency range by a transposition process to produce a transposed audio signal; and summing the transposed audio signal with the audio signal to generate an output signal, wherein the transposition process includes: estimating an all-pole spectral envelope of the filtered signal; applying a warping function to the all-pole spectral envelope of the filtered signal to translate the poles above a specified knee frequency to lower frequencies, thereby producing a warped spectral envelope; and exciting the warped spectral envelope with an excitation signal to synthesize the transposed audio signal. It also provides for scaling the transposed audio signal and summing the scaled transposed audio signal with the audio signal. It is contemplated that the filtering includes, but is not limited to high pass filtering or high bandpass filtering. In various embodiments, the estimating includes performing linear prediction. In various embodiments, the estimating is done in the frequency domain. In various embodiments the estimating is done in the time domain.

In various embodiments, the pole frequencies are translated toward the knee frequency and may be done so linearly using a warping factor or non-linearly, such as using a logarithmic or other non-linear function. Such translations may be limited to poles above the knee frequency.

In various embodiments, the excitation signal is a prediction error signal, produced by filtering the high-pass signal with an inverse of the estimated all-pole spectral envelope. The present subject matter in various embodiments includes randomizing a phase of the prediction error signal, including translating the prediction error signal to the frequency domain using a discrete Fourier Transform; randomizing a phase of components below a Nyquist frequency; replacing components above the Nyquist frequency by a complex conjugate of the corresponding components below the Nyquist frequency to produce a valid spectrum of a purely real time domain signal; inverting the DFT to produce a time domain signal; and using the time domain signal as the excitation signal. It is understood that in various embodiments the prediction error signal is processed by using, among other things, a compressor, peak limiter, or other nonlinear distortion to reduce a peak dynamic range of the excitation signal. In various embodiments the excitation signal is a spectrally shaped or filtered noise signal.

In various embodiments the system includes combining the transposed signal with a low-pass filtered version of the audio signal to produce a combined output signal, and in some embodiments the transposed signal is adjusted by a gain factor prior to combining The system also provides the ability to modify pole magnitudes and frequencies.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates to improved speech intelligibility in a hearing assistance device using frequency translation by high-frequency spectral envelope warping. The system described herein implements an algorithm for performing frequency translation in an audio signal processing device for the purpose of improving perceived sound quality and speech intelligibility in an audio signal when presented using a system having reduced bandwidth relative to the original signal, or when presented to a hearing-impaired listener sensitive to only a reduced range of acoustic frequencies.

One goal of the proposed system is to improve speech intelligibility in the reduced-bandwidth presentation of the processed signal, without compromising the overall sound quality, that is, without introducing undesirable perceptual artifacts in the processed signal. In embodiments implemented in a real-time listening device, such as a hearing aid, the system must conform to the computation, latency, and storage constraints of such real-time signal processing systems.

Hearing Assistance Device Application

Figure 1:
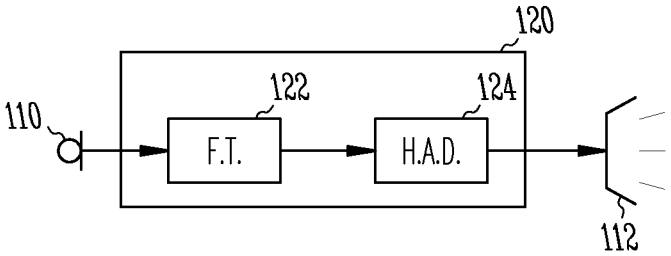
FIG. 1 is a block diagram of a hearing assistance device including a frequency translation element according to one embodiment of the present subject matter.

In one application, the present frequency translation system is incorporated into a hearing assistance device to provide improved speech intelligibility without undesirable perceptual artifacts in the processed signal. FIG. 1 demonstrates a block diagram of a hearing assistance device including a frequency translation element according to one embodiment of the present subject matter. The hearing assistance device includes a microphone 110 which provides signals to the electronics 120. The electronics 120 provide a processed signal for speaker 112. The electronics 120 include, but are not limited to, hearing assistance device system 124 and frequency translation system 122. It is understood that such electronics and systems may be implemented in hardware, software, firmware, and various combinations thereof. It is also understood that certain applications may not employ this exact set of components and/or arrangement. For example, in the application of cochlear implants, no speaker 112 is necessary. In the example of hearing aids, speaker 112 is also referred to as a "receiver." In the hearing aid example, electronics 120 may be implemented in different embodiments, including analog hardware, digital hardware, or various combinations thereof. In digital hearing aid embodiments, electronics 120 may be a digital signal processor or other form of processor. It is understood that electronics 120 in various embodiments may include additional devices such as memory or other circuits. In one digital hearing aid embodiment, hearing assistance device system 124 is implemented using a time domain approach. In one digital hearing aid embodiment, hearing assistance device system 124 is implemented using a frequency domain approach. In various embodiments the hearing assistance device system 124 may be programmed to perform hearing aid functions including, but not limited to, programmable frequency-gain, acoustic feedback cancellation, peak limiting, environment detection, and/or data logging, to name only a few. In hearing aid applications with rich digital signal processor designs, the frequency translation system 122 and hearing assistance device system 124 are implemented by programming the digital signal processor to perform the desired algorithms on the signal received from microphone 110. Thus, it is understood that such systems include embodiments that perform both frequency translation and hearing aid processing in a common digital signal processor. It is understood that such systems include embodiments that perform frequency translation and hearing aid processing using different processors. Variations of hardware, firmware, and software may be employed without departing from the scope of the present subject matter.

Frequency Translation System Example

Figure 2:
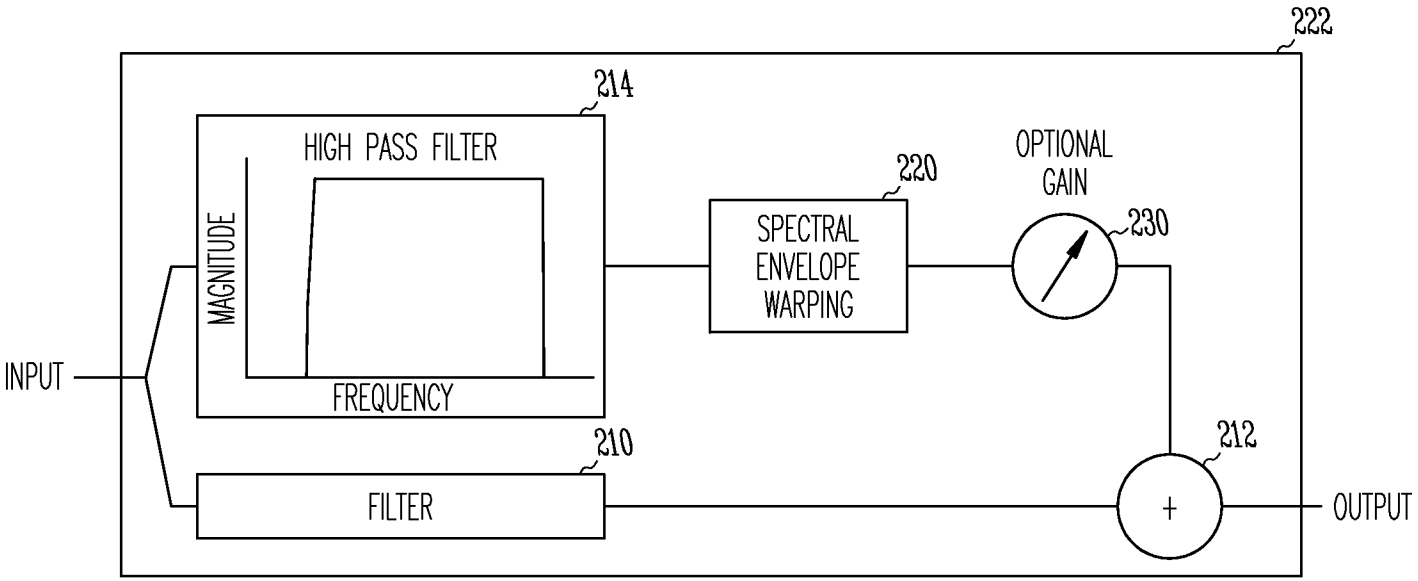
FIG. 2 is a signal flow diagram of a frequency translation system according to one embodiment of the present subject matter.

FIG. 2 is a signal flow diagram of a frequency translation system 122 according to one embodiment of the present subject matter. The diagram in FIG. 2 depicts a two-branch algorithm in which the spectral envelope of the signal in the high-pass branch is warped such that peaks in the spectral envelope are translated to lower frequencies. In one embodiment, the spectral envelope of the signal in the high-pass branch is estimated by linear predictive analysis, and the frequencies of the peaks in the spectral envelope are determined from the coefficients of the filter so derived. Various linear predictive analysis approaches are possible. One source of information about linear prediction is provided by John Makhoul in *Linear Prediction: A Tutorial Review*, Proceedings of the IEEE, Vol. 63, No. 4, April 1975, which is incorporated by reference in its entirety. Linear prediction includes, but is not limited to, autoregressive modeling or all-pole modeling. The peak frequencies are translated to new (lower) frequencies and used to specify a synthesis filter, which is applied to the residue signal obtained by inverse-filtering the analyzed signal by the unmodified (before warping) prediction filter. The (warped) filtered residue signal, possibly with some gain applied, is combined with the signal in the lower branch (not processed by frequency translation) of the algorithm to produce the final output signal. This combination of distinct high-pass and pass-through branches with spectral envelope warping in the high-pass frequency translation branch guarantees that signals that should not be translated (for example, low-frequency voiced speech) pass through the system without artifacts or alteration, and allows explicit and controlled balancing of the processed and unprocessed signals. Moreover, by processing a high-pass signal, instead of the full-bandwidth signal, no computational burden (linear prediction coefficients or pole frequencies, for example) is incurred due to the relatively higher-energy part of the signal that should not be translated in frequency.

The system of FIG. 2 includes two signal branches. The upper branch in the block diagram in FIG. 2 contains the frequency translation processing 220 performed on the audio signal. In this embodiment, frequency translation processing 220 is applied only to the signal in a highpass (or high bandpass) region of the spectrum passed by filter 214. The signal in the lower branch is not processed by frequency translation.

The filter 210 in the lower branch of the diagram may have a lowpass or allpass characteristic, and should, at a minimum, pass all of the energy rejected by the filter in the upper branch, so that all of the spectral energy in the signal is represented in at least one of the branches of the algorithm. The processed and unprocessed signals are combined in the summing block 212 at the right edge of the block diagram to produce the overall output of the system. A gain control 230 may be optionally included in the upper branch to regulate the amount of the processed signal energy in the final output.

Figure 3:
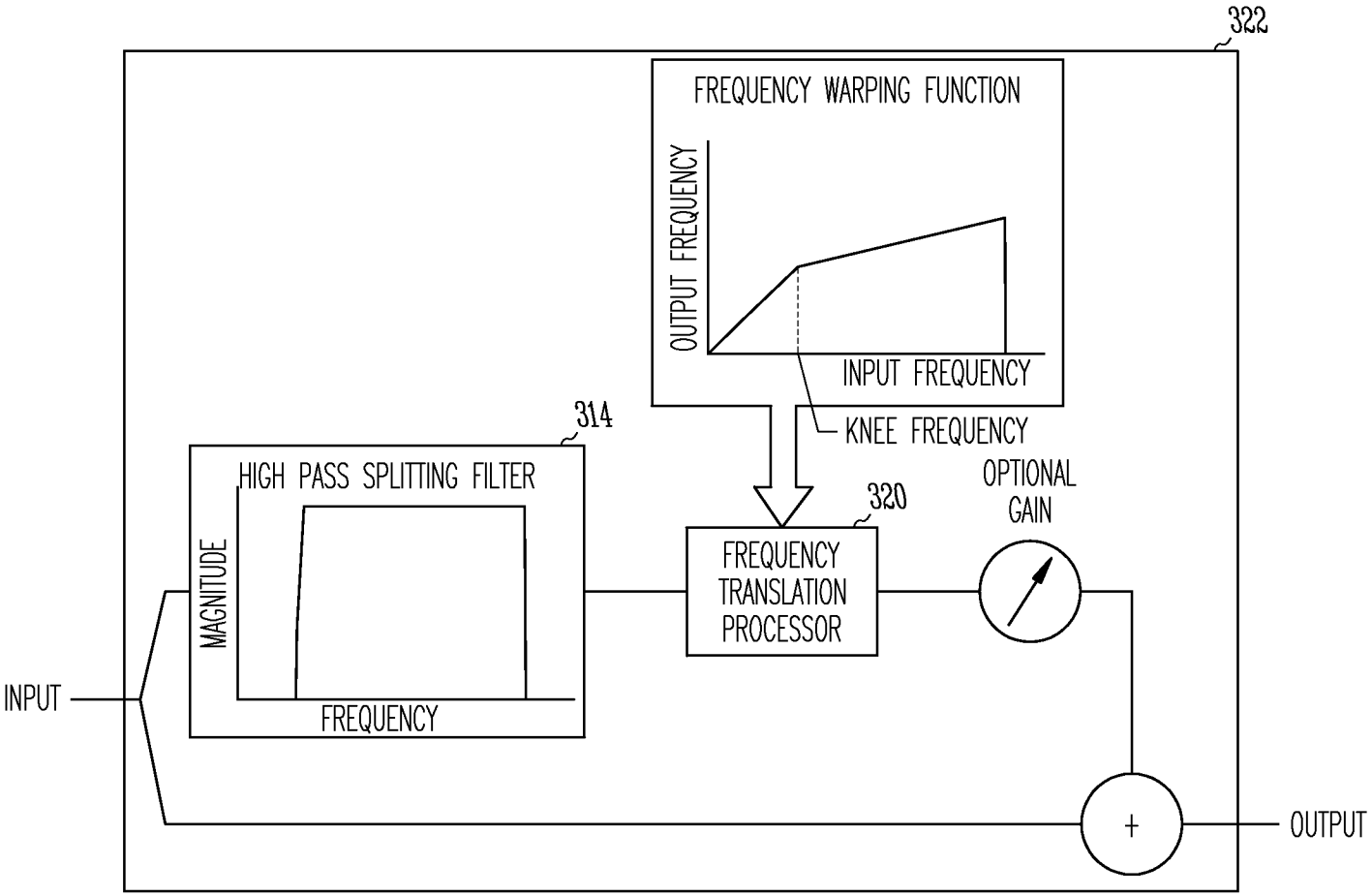
FIG. 3 is a signal flow diagram of a frequency translation system according to one embodiment of the present subject matter.

In one embodiment, the filter 210 in the lower block is omitted. In one embodiment the filter 210 is replaced by a simple delay compensating for the delay incurred by filtering in the upper processing branch. FIG. 3 shows more detail of one frequency translation system of FIG. 2 according to one embodiment of the present subject matter. In FIG. 3 the left-most block of the processing branch of frequency translation system 322 is called a splitting filter 314. The function of the splitting filter 314 is to isolate the high-frequency part of the input audio signal for frequency translation processing. The cutoff frequency of this high-pass (or high bandpass) filter 314 is one of the parameters of the system, and we will call it the splitting frequency. The motivation for employing a splitting filter 314 in our system is to leave unaltered the low-frequency part of the audio signal, which is the part that lies within the limited-bandwidth region in which the signal will be presented or received, and that usually dominates the sound quality of the overall signal. Frequency translation processing is to be applied primarily to parts of the signal that would otherwise be inaudible, or fall outside of the limited available bandwidth. In speech processing applications it is intended that primarily the parts of speech having substantial high-frequency content, such as fricative and sibilant consonants, are frequency translated. Other spectral regions, such as the lower-frequency regions containing harmonic information, critical for the perceived voice quality, and the first two vowel formants, critical for vowel perception, may be unaffected by the processing, because they will be suppressed by the splitting filter 314.

Figure 4:
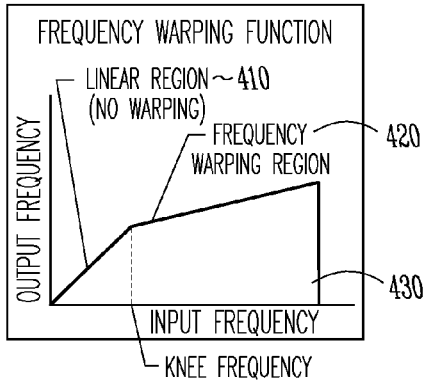
FIG. 4 illustrates a frequency warping function used in the frequency translation system according to one embodiment of the present subject matter.

In one embodiment the frequency translation processor 320 is programmed to perform a piecewise linear frequency warping function. Greater detail of one embodiment is provided in FIG. 4, which depicts an input-output frequency relationship. In one embodiment, the warping function consists of two regions: a low-frequency region 410 in which no warping is applied, and a high-frequency warping region 420, in which energy is translated from higher to lower frequencies. The frequency corresponding to the breakpoint in this function, dividing the two regions, is called the knee point, or knee frequency 430, in the warping curve. Energy above this frequency is translated towards, but not below, the knee frequency 430. The amount by which this energy is translated in frequency is determined by the slope of the frequency warping curve in the warping region called a warping ratio. Precisely, the warping ratio is the inverse of the slope of the warping function above the knee point. In processor-based implementations, the knee point and warping ratio are parameters of the frequency translation algorithm.

Figure 5:
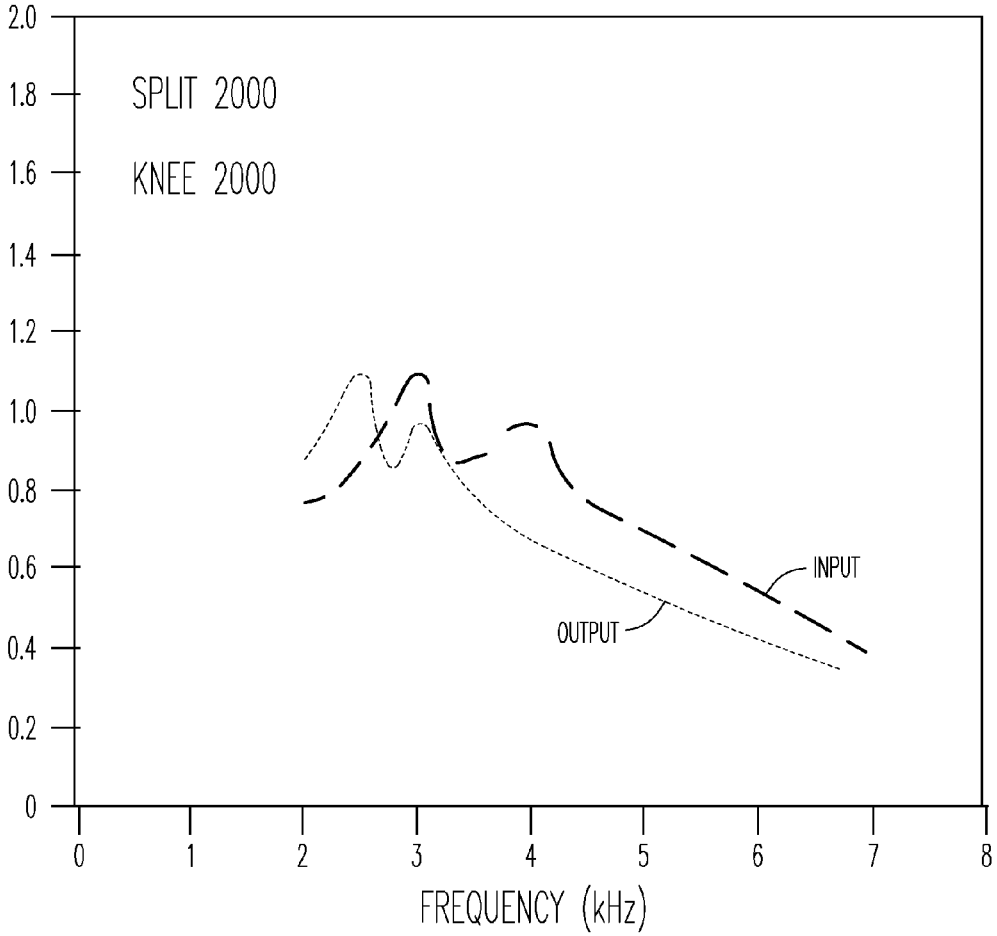
FIGS. 5-7 demonstrate data for various frequency translations using different combinations of splitting frequency, knee frequency and warping ratio, according to various embodiments of the present subject matter.
Figure 6:
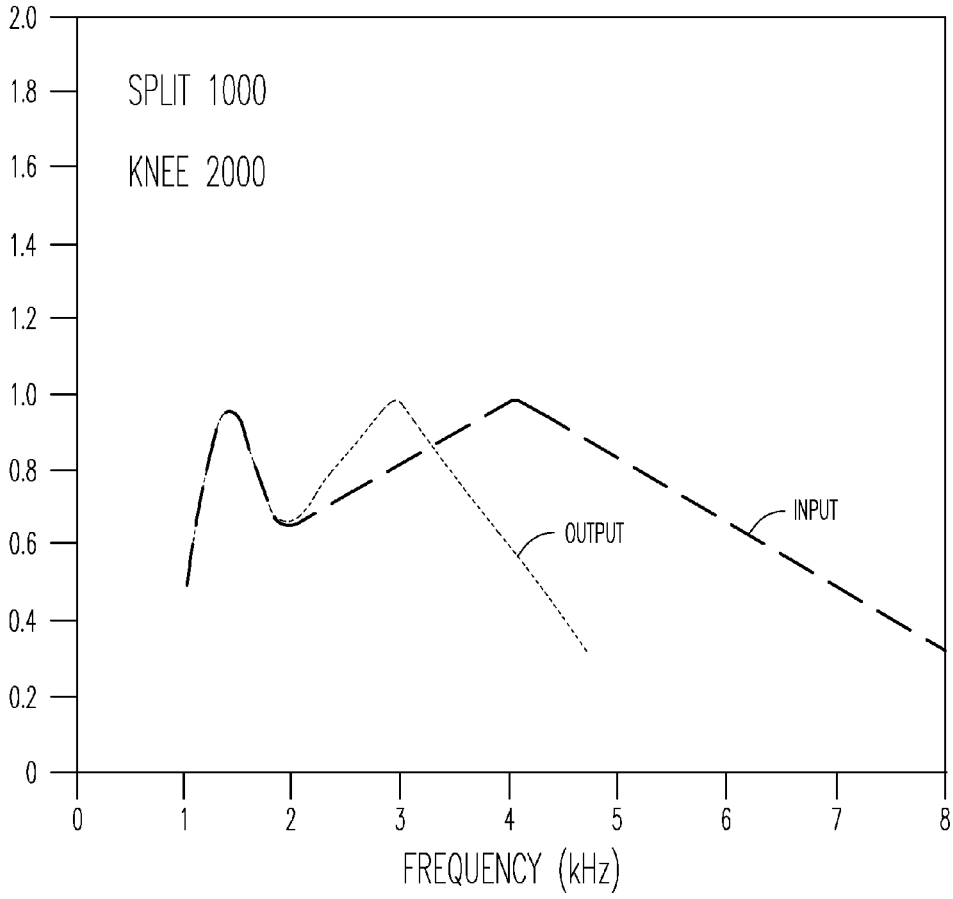
Figure 7:
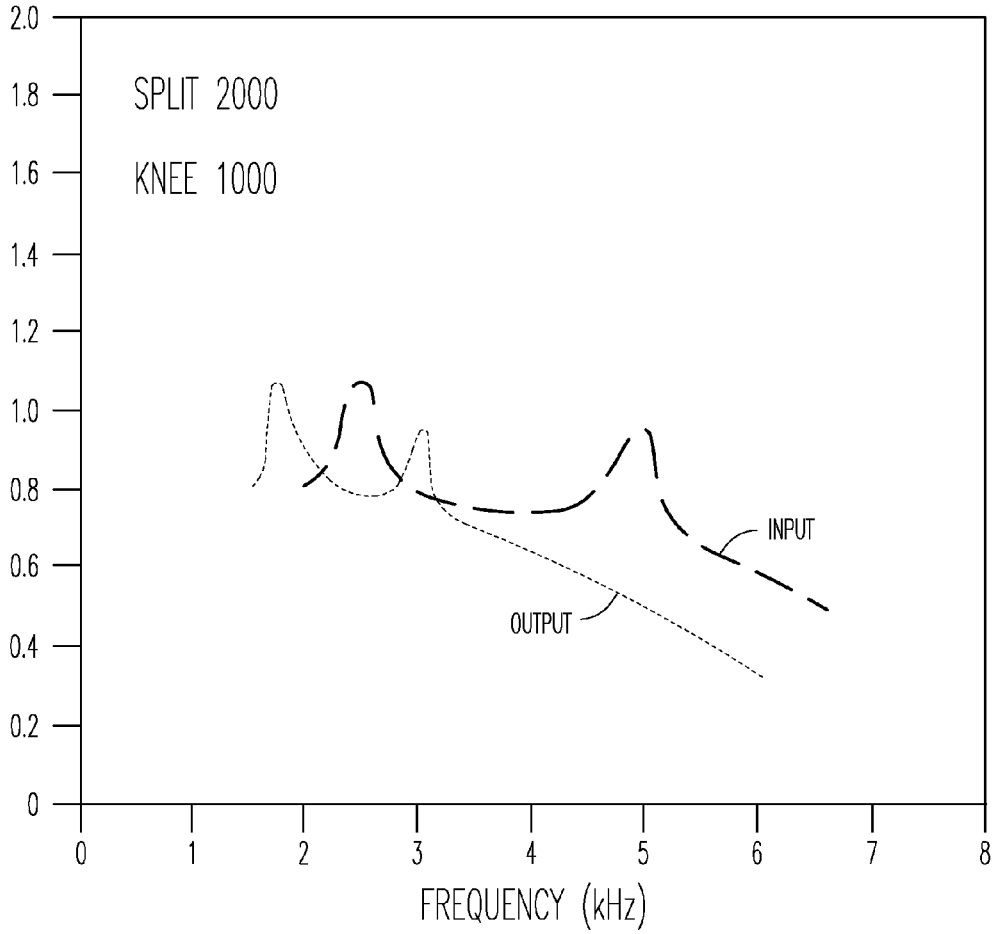

The three algorithm parameters described above, the splitting frequency, the warping function knee frequency, and the warping ratio, determine which parts of the spectral envelope are processed by frequency translation, and the amount of translation that occurs. FIGS. 5 through 7 depict the frequency translation processing for three different configurations of the three parameters. The abscissa represents increasing frequency, the units on the ordinate are arbitrary. The line having large dashes represents a hypothetical input frequency envelope, and the line with small dots represents the corresponding translated spectral envelope. In FIG. 5, the splitting frequency and knee frequency are both 2 kHz, so energy in the envelope above 2 kHz is warped toward that frequency. The overall signal bandwidth is reduced and the peaks in the envelope have been translated to lower frequencies. FIG. 6 depicts the case of the splitting frequency, at 1 kHz, being lower than the knee frequency in the warping function. In this case energy above 1 kHz is processed by frequency translation, but energy below 2 kHz is not translated, so one of the peaks in the spectral envelope is translated as shown in FIG. 6. Thus, in FIG. 6, some of the energy in the processing branch, the energy between 1 kHz (the splitting frequency) and 2 kHz (the knee frequency), is not translated to lower frequencies because it is below the knee frequency. In FIG. 7, the knee frequency in the frequency warping curve is 1 kHz, lower in frequency than the splitting frequency, which remains at 2 kHz. As in FIG. 5, only energy above 2 kHz is processed, but in this case, the envelope energy is translated towards 1 kHz, so one of the peaks in the envelope is translated to a frequency lower than the splitting frequency. Thus, in FIG. 7 some energy (or part of the envelope) is translated to a region below the splitting frequency. Consequently, before translation the processing branch included only spectral peaks above the splitting frequency, and after translation a peak was present at a frequency below the splitting frequency. The examples provided in FIGS. 5-7 show how the various settings of the algorithm parameters translate peaks in the spectral envelope. In various embodiments, these figures depict changes to the signal in the highpass branch only. In such embodiments, there is no overall signal bandwidth reduction in general, because the processed signal is ultimately mixed in with the original signal.

Figure 8A:
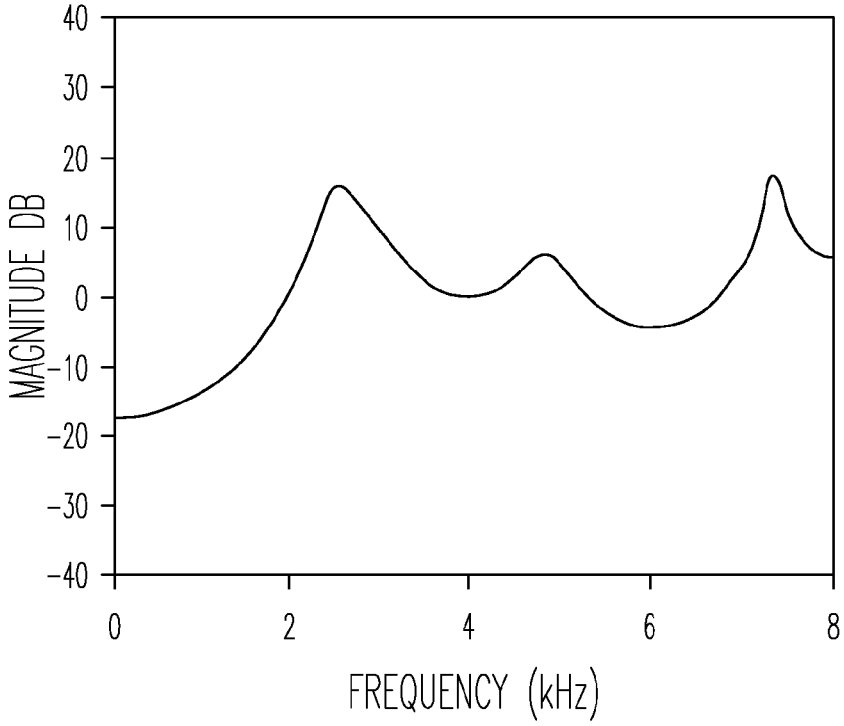
FIGS. 8A and 8B demonstrate one example of the effect of warping on the spectral envelope using a frequency translation system according to one embodiment of the present subject matter.
Figure 8B:
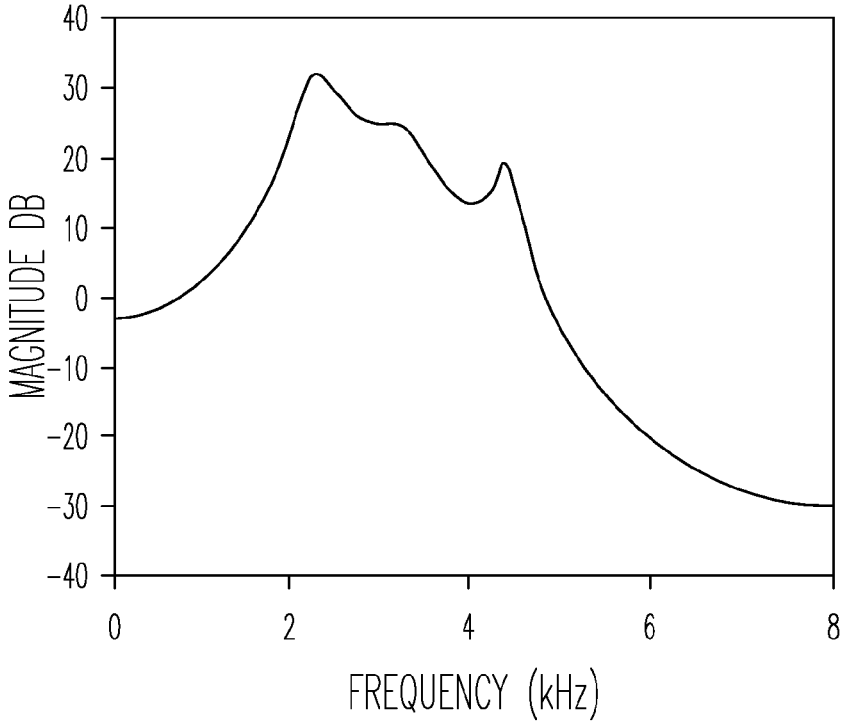

The frequency warping function governs the behavior of the frequency translation processor, whose function is to alter the shape of the spectral envelope of the processed signal. In such embodiments, the pitch of the signal is not changed, because the spectral envelope, and not the fine structure, is affected by the frequency translation process. This process is depicted in FIGS. 8A and 8*b*, which shows the spectral envelope for a short segment of speech before (FIG. 8A) and after (FIG. 8B) frequency translation processing. The spectral envelope is estimated for a short-time segment of the input signal by a method of linear prediction (also known as autoregressive modeling), in which a signal is decomposed into an all-pole (recursive, or autoregressive) filter describing the spectral envelope of the signal, and a whitened (spectrally-flattened) excitation signal that can be processed by the all-pole filter to recover the original signal. The frequencies of the filter's complex pole pairs determine the location of peaks in the spectral envelope. There are three peaks in the spectral envelope depicted in FIGS. 8A and 8B, corresponding to three pairs of poles (six non-trivial filter coefficients) in the estimated all-pole filter. Consequently, the number of coefficients used in the estimation of the spectral envelope is a parameter of the algorithm.

In one embodiment of the present system a whitened excitation signal, derived from linear predictive analysis, is processed using a warped spectral envelope filter to construct a new signal whose spectral envelope is a warped version of the envelope of the input signal, having peaks above the knee frequency translated to lower frequencies. In one embodiment, the peak frequencies are computed directly from the values of the complex poles in the filter derived by linear prediction. In one embodiment the peak frequencies are estimated by examination of the frequency response of the filter.

Other approaches for determining the peak frequencies are possible without departing from the scope of the present subject matter.

By translating the peak frequencies according to the frequency warping function described above, a new warped spectral envelope is specified which is used to determine the coefficients of the warped spectral envelope filter. In one embodiment, the filter pole frequencies can be modified directly, so that the spectral envelope described by the filter is warped, and peak frequencies above the knee frequency (such as 2 kHz shown in FIGS. 8A and 8B) in the warping function are translated toward, but not below, that frequency. It is understood that in some cases, two filter poles can be close together in frequency, creating a peak in the spectral envelope at a frequency that is different from the two pole frequencies. It is understood that various approaches to translating peak frequencies can be applied. In one embodiment, new pole frequencies are specified to produce a desired translation of envelope peak frequencies. In one embodiment, a new envelope peak frequency is specified. Other approaches are possible without departing from the scope of the present subject matter.

The whitened excitation signal, derived from linear predictive analysis, may be subjected to further processing to mitigate artifacts that are introduced when the high-frequency part of the input signal contains very strong tonal or sinusoidal components. For example, the excitation signal may be made maximally noise-like (and less impulsive) by a phase randomization process. This can be achieved in the frequency domain by computing the discrete Fourier transform (DFT) of the excitation signal, and expressing the complex spectrum in polar form (magnitude and phase, or angle). The phase of components at and below the Nyquist frequency (half the sampling frequency) are replaced by random values, and the components above the Nyquist frequency are made equal to the complex conjugate of corresponding (mirrored about the Nyquist component) components below the Nyquist frequency, so that the representation corresponds to a real time domain signal. This frequency domain representation is then inverted to obtain new excitation signal.

In various alternative embodiments, the excitation signal may be replaced by a shaped (filtered) noise signal. The noise may be shaped to behave like a speech-like spectrum, or may be shaped by a highpass filter, and possibly using the same splitting filter used to isolate the high-frequency part of the input signal. In such an implementation, it is generally not necessary to compute the excitation (prediction error) signal in the linear predictive analysis stage.

In other alternative embodiments, the excitation signal may be subjected to dynamics processing, such as dynamic range compression or limiting, or to non-linear waveform distortion to reduce its impulsiveness, and the artifacts associated with frequency transposition of signals with strongly tonal high-frequency components.

The output of the frequency translation processor, consisting of the high-frequency part of the input signal having its spectral envelope warped so that peaks in the envelope are translated to lower frequencies, and optionally scaled by a gain control, is combined with the original, unmodified signal to produce the output of the algorithm.

The present system provides the ability to govern in very specific ways the energy injected at lower frequencies according to the presence of energy at higher frequencies.

Time Domain Spectral Envelope Warping Example

Figure 9:
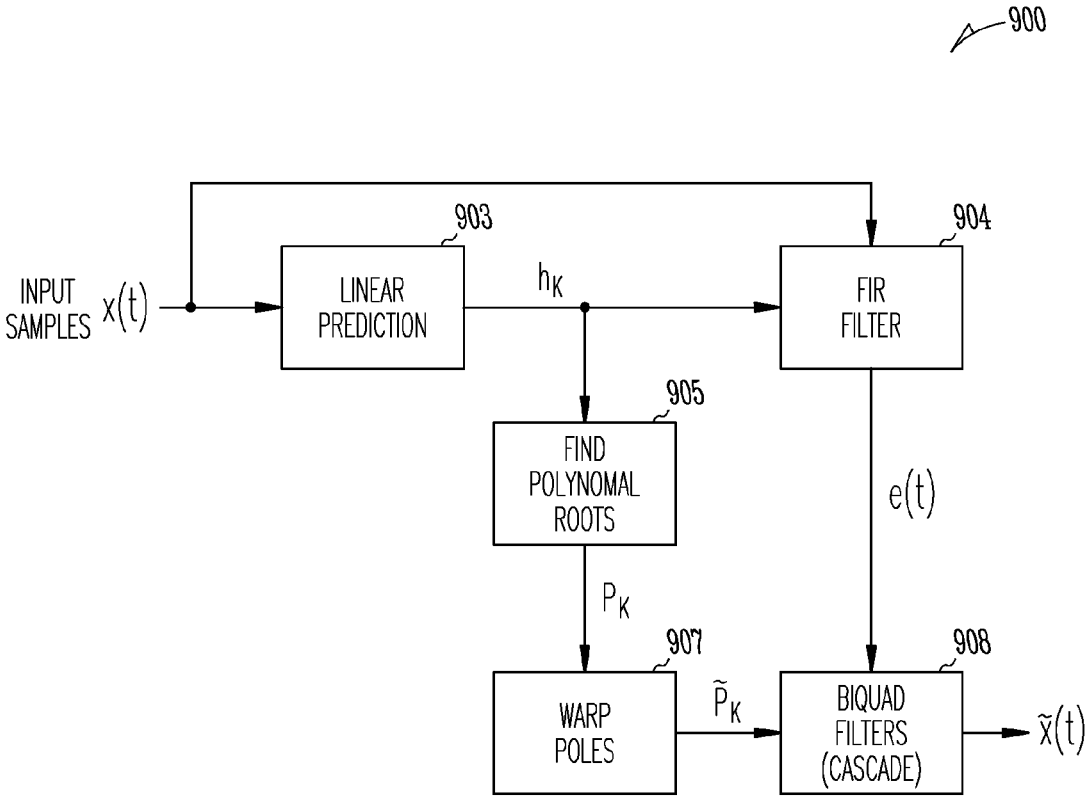
FIG. 9 is a signal flow diagram demonstrating a time domain spectral envelope warping process for the frequency translation system according to one embodiment of the present subject matter.

FIG. 9 shows a time domain spectral envelope warping process according to one embodiment of the present subject matter. It is understood that this example is not intended to be limiting or exclusive, but rather demonstrative of one way to implement a time domain warping process.

In the time domain process of FIG. 9, sound is sampled from a microphone or other sound source (x(t)) and provided to the spectral envelope warping system 900. The input samples are applied to a linear prediction analysis block 903 and a finite-impulse-response filter 904 ("FIR filter 904"). The outputs of the linear prediction analysis block 902 are filter coefficients ($h_k$) which are used by the FIR filter 904 to filter the input samples (x(t)) to produce the prediction error, or excitation signal, e(t). The filter coefficients ($h_k$) are used to find polynomial roots ($P_k$) 905 which are then warped to provide warped poles ($\{P_k\}$) 907. The excitation signal, e(t), and warped poles ($\{P_k\}$) are used by an all pole filter 908, such as a biquad filter arrangement, to filter the excitation signal with the warped all pole filter. The resultant output is a sampled warped spectral envelope signal ($\{x(t)\}$).

It is understood that variations in process order and particular filters may be substituted in systems without departing from the scope of the present subject matter.

Frequency Domain Spectral Envelope Warping Example

Figure 10:
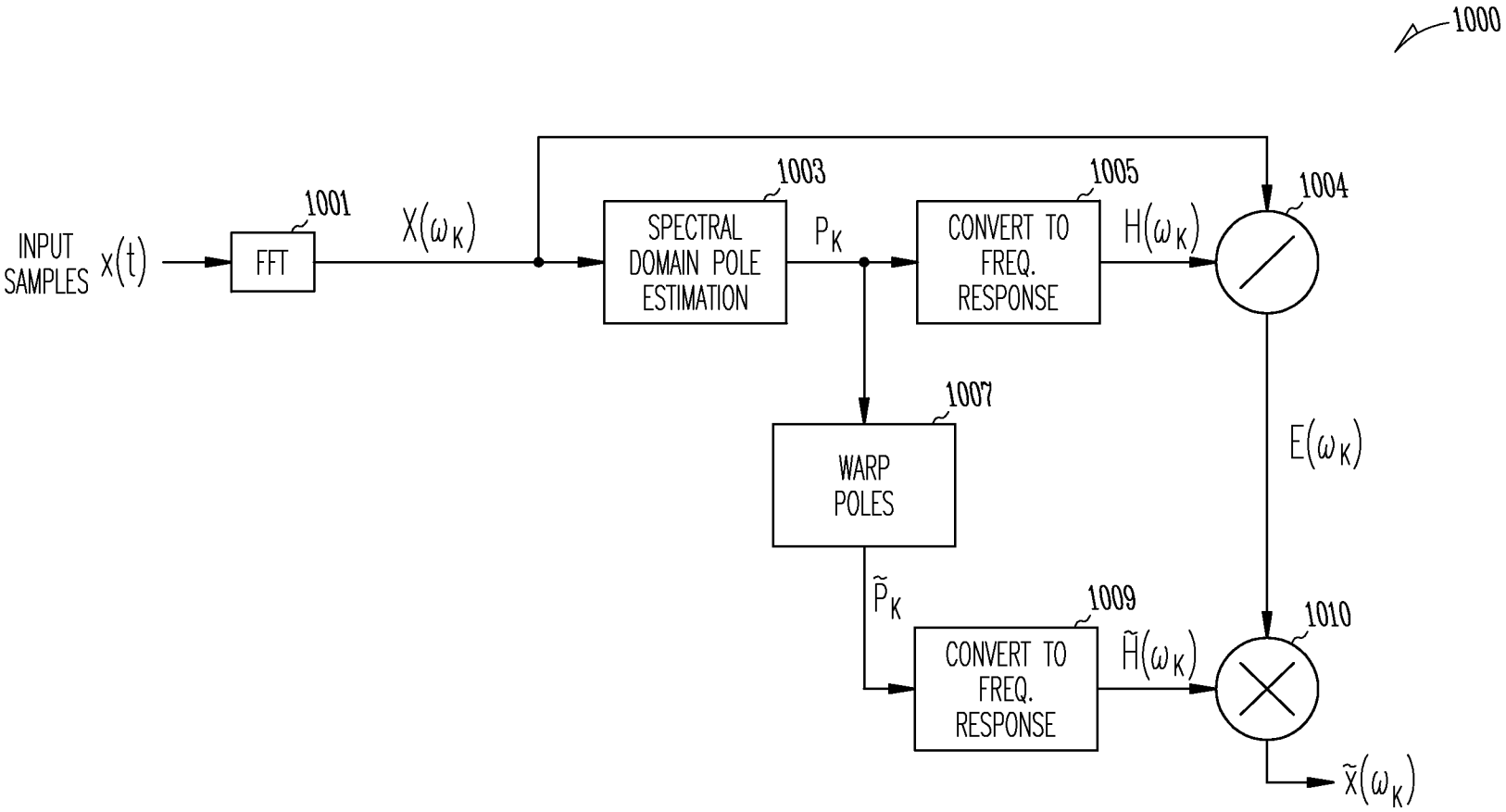
FIG. 10 is a signal flow diagram demonstrating a frequency domain spectral envelope warping process for the frequency translation system according to one embodiment of the present subject matter.

FIG. 10 shows a frequency domain spectral envelope warping process according to one embodiment of the present subject matter. It is understood that this example is not intended to be limiting or exclusive, but rather demonstrative of one way to implement a frequency domain warping process.

In the frequency domain process of FIG. 10, sound is sampled from a microphone or other sound source (x(t)) and converted into frequency domain information, such as sub-bands ($X(w_k)$), before it is provided to the spectral envelope warping system 1000. One such conversion approach is the use of a fast Fourier Transform (FFT) 1001. The input sub-band ($X(w_k)$) samples are applied to a spectral domain pole estimation block 1003 to perform spectral domain pole estimation and to a divider 1004. "Linear Prediction: A Tutorial Review", John Makhoul, *Proceedings of the IEEE*, Vol. 63, No. 4, April 1975. The spectral domain pole estimation block 1003 is used to find polynomial roots ($P_k$) which are then converted into a complex frequency response $H(w_k)$ by process 1005. The input sub-band signals $X(w_k)$ are divided by the complex frequency response $H(w_k)$ by divider 1004 to whiten the spectrum of the input sub-band signals $X(w_k)$ and to produce a complex sub-band prediction error, or complex sub-band excitation signal, $E(w_k)$. The polynomial roots ($P_k$) are then warped to provide warped poles ($\{P_k\}$) 1007. The warped poles ($\{P_k\}$) are converted to a complex frequency response $\{H(w_k)\}$ 1009.

The complex sub-band excitation signal, $E(w_k)$, and complex frequency response $\{H(w_k)\}$ are multiplied 1010 to provide a sampled warped spectral envelope signal in the frequency domain $\{X(w_k)\}$. This sampled warped spectral envelope signal in the frequency domain $\{X(w_k)\}$ can be further processed in the frequency domain by other processes and ultimately converted into the time domain for transmission of processed sound according to one embodiment of present subject matter.

Examples of Combined Whitening and Shaping Filters

In some embodiments, computational savings can be achieved by combining the application of the all-zero FIR filter, to generate the prediction error signal, and the application of the all-pole warped spectral envelope filter to the excitation signal, into a single filtering step.

The all-pole spectral envelope filter is normally implemented as a cascade (or sequence) of second-order filter sections, so-called biquad sections or biquads. Those practiced in the art will recognize that, for reasons of numerical stability and accuracy, as well as efficiency, high-order recursive filters should be implemented as a cascade of low-order filter sections. In the implementation of an all-pole filter, each biquad section has only two poles in its transfer functions, and no (non-trivial) zeros. However, the zeros in the FIR filter can be implemented in the biquad sections along with the spectral envelope poles, and in this case, the FIR filtering step in the original frequency translation algorithm can be eliminated entirely. An example is provided by the system 1100 in FIG. 11.

Figure 11:
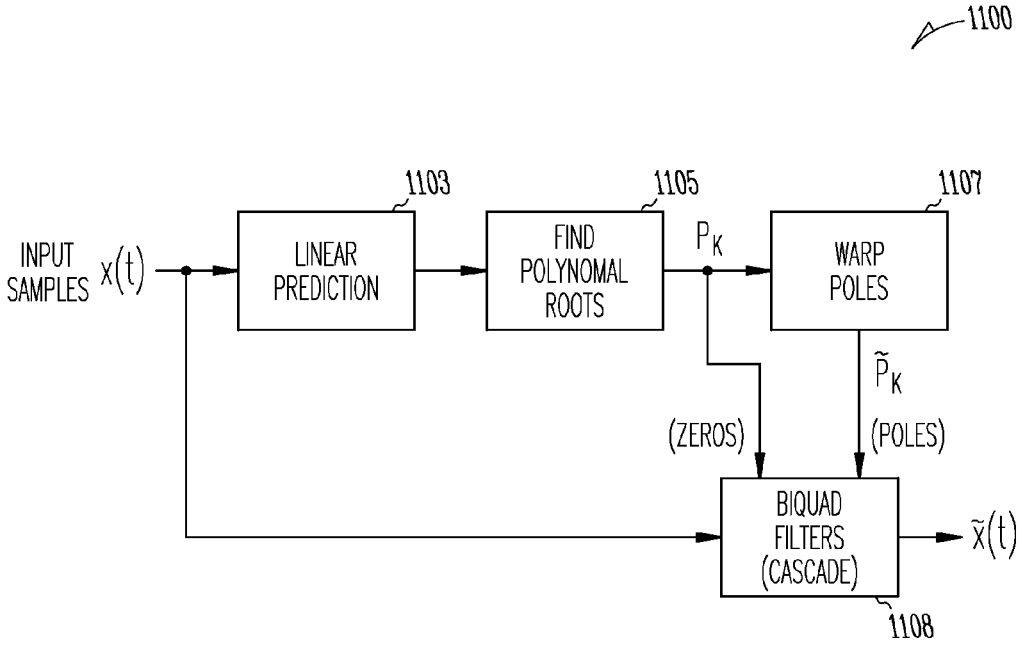
FIG. 11 is a signal flow diagram demonstrating a time domain spectral envelope warping process for the frequency translation system combining the whitening and shaping filters according to one embodiment of the present subject matter.

In FIG. 11, input samples x(t) are provided to the linear prediction block 1103 and biquad filters (or filter sections) 1108. The output of linear prediction block 1103 is provided to find the polynomial roots 1105, $P_k$. The polynomial roots $P_k$, are provided to biquad filters 1108 and to the pole warping block 1107. The roots $P_k$ specify the zeros in the biquad filter sections. The resulting output of pole warping block 1107, $\{\{P_k\}\}$, is applied to the biquad filters 1108 to produce the warped output $\{\{x(t)\}\}$. The warped roots $\{\{P_k\}\}$ specify the poles in the biquad filter sections.

In one embodiment, the zeros corresponding to (unwarped) roots of the predictor polynomial should be paired in a single biquad section with their counterpart warped poles in the frequency translation algorithm. Since not all poles in the spectral envelope are transformed in the frequency translation algorithm (only complex poles above a specified knee frequency), some of the biquad sections that result from this pairing will have unity transfer functions (the zeros and unwarped poles will coincide). Since the application of these sections ultimately has no effect on a signal, they can be omitted entirely, resulting in computational savings and improved filter stability.

In the present frequency translation algorithm, the high-pass splitting filter makes poles on the positive real axis uncommon, but it frequently happens that poles are found on the negative real axis (poles at the Nyquist frequency, or half the sampling frequency) and these poles should not be warped, but should rather remain real poles (at the Nyquist frequency) in the warped spectral envelope. Moreover, it may happen that a pole is found below the knee frequency in the warping function, and such a pole need not be warped. Poles such as these whose frequencies are not warped can be omitted entirely from the filter design. In the case of a predictor of order 8, for example, if one pole pair is found on the negative real axis, a 25% savings in filtering costs can be achieved by omitting one second order section. If additionally one of the poles is below the knee frequency, the savings increases to 50%.

In addition to achieving some computational savings, this modification may make the biquad filter sections more numerically stable. In some embodiments, for reasons of numerical stability and accuracy, filter sections including both poles and zeros are implemented, rather than only poles.

It is understood that the system of FIG. 11 can be implemented in the frequency domain by combining the frequency response $H(w_k)$ and the warped frequency response $\{H(w_k)\}$ of FIG. 10 before performing the multiply 1010. Other frequency domain variations are possible without departing from the scope of the present subject matter.

It is understood that variations in process order and particular conversions may be substituted in systems without departing from the scope of the present subject matter.

The present subject matter includes a method for processing an audio signal received by a hearing assistance device, including: filtering the audio signal to generate a high frequency filtered signal, the filtering performed at a splitting frequency; transposing at least a portion of an audio spectrum of the filtered signal to a lower frequency range by a transposition process to produce a transposed audio signal; and summing the transposed audio signal with the audio signal to generate an output signal, wherein the transposition process includes: estimating an all-pole spectral envelope of the filtered signal; applying a warping function to the all-pole spectral envelope of the filtered signal to translate the poles above a specified knee frequency to lower frequencies, thereby producing a warped spectral envelope; and exciting the warped spectral envelope with an excitation signal to synthesize the transposed audio signal. It also provides for scaling the transposed audio signal and summing the scaled transposed audio signal with the audio signal. It is contemplated that the filtering includes, but is not limited to high pass filtering or high bandpass filtering. In various embodiments, the estimating includes performing linear prediction. In various embodiments, the estimating is done in the frequency domain. In various embodiments the estimating is done in the time domain.

In various embodiments, the pole frequencies are translated toward the knee frequency and may be done so linearly using a warping factor or non-linearly, such as using a logarithmic or other non-linear function. Such translations may be limited to poles above the knee frequency.

In various embodiments, the excitation signal is a prediction error signal, produced by filtering the high-pass signal with an inverse of the estimated all-pole spectral envelope. The present subject matter in various embodiments includes randomizing a phase of the prediction error signal, including translating the prediction error signal to the frequency domain using a discrete Fourier Transform; randomizing a phase of components below a Nyquist frequency; replacing components above the Nyquist frequency by a complex conjugate of the corresponding components below the Nyquist frequency to produce a valid spectrum of a purely real time domain signal; inverting the DFT to produce a time domain signal; and using the time domain signal as the excitation signal. It is understood that in various embodiments the prediction error signal is processed by using, among other things, a compressor, peak limiter, or other nonlinear distortion to reduce a peak dynamic range of the excitation signal. In various embodiments the excitation signal is a spectrally shaped or filtered noise signal.

In various embodiments the system includes combining the transposed signal with a low-pass filtered version of the audio signal to produce a combined output signal, and in some embodiments the transposed signal is adjusted by a gain factor prior to combining The system also provides the ability to modify pole magnitudes and frequencies.

The present subject matter includes hearing assistance devices, including, but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having a receiver in-the-canal. It is understood that other hearing assistance devices not expressly stated herein may fall within the scope of the present subject matter It is understood one of skill in the art, upon reading and understanding the present application will appreciate that variations of order, information or connections are possible without departing from the present teachings. This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

We claim:

1. A hearing assistance apparatus, comprising:

a filter configured to receive an audio signal and to generate a high frequency filtered signal at a splitting frequency; and a frequency translation system configured to transpose at least a portion of an audio spectrum of the filtered signal to a lower frequency range, including applying a warping function to produce a transposed audio signal, and further configured to sum the transposed signal with the audio signal to generate an output signal, wherein the frequency translation system is configured to perform a transposition process including estimating an all-pole spectral envelope of the filtered signal.

2. The apparatus of claim 1, wherein the filter includes a high pass filter.

3. The apparatus of claim 1, wherein the filter includes a high bandpass filter.

4. The apparatus of claim 1, wherein the frequency translation system is adapted to scale the transposed audio signal and sum the scaled transposed audio signal with the audio signal.

5. The apparatus of claim 1, wherein the transposition process is proportionally done according to a warping factor.

6. The apparatus of claim 1, wherein the estimating includes performing linear prediction.

7. The apparatus of claim 1, wherein the estimating is done in the frequency domain.

8. The apparatus of claim 1, wherein the estimating is done in the time domain.

9. The apparatus of claim 1, wherein the transposition process includes applying a warping function to the all-pole model of the spectral envelope of the filtered signal to translate the poles above a specified knee frequency to lower frequencies, thereby producing a warped spectral envelope.

10. The apparatus of claim 9, wherein the transposition process includes exciting the warped spectral envelope with an excitation signal to synthesize the transposed audio signal.

11. A hearing assistance device, comprising:

a microphone configured to receive an acoustic input signal and to produce an audio signal;

a filter configured to receive the audio signal and generate a filtered signal at a splitting frequency;

hearing assistance electronics configured to transpose at least a portion of an audio spectrum of the filtered signal to a lower frequency range, including applying a warping function to produce a transposed audio signal, and further configured to sum the transposed signal with the audio signal to generate an output signal; and a speaker configured to receive the output signal and produce an acoustic output signal, wherein the hearing assistance electronics are configured to perform a transposition process including estimating an all-pole spectral envelope of the filtered signal.

12. The device of claim 11, wherein the transposition process further includes:

applying a warping function to the all-pole model of the spectral envelope of the filtered signal to translate the poles above a specified knee frequency to lower frequencies, thereby producing a warped spectral envelope; and exciting the warped spectral envelope with an excitation signal to synthesize the transposed audio signal.

13. The device of claim 12, wherein the transposition process further includes translating pole frequencies above the knee frequency towards the knee frequency.

14. The device of claim 13, wherein the translating is proportionally done according to a warping factor.

15. The device of claim 13, wherein the translating is not performed below the knee frequency.

16. The device of claim 13, wherein the translating is performed non-linearly towards the knee frequency.

17. The device of claim 16, wherein the translating is not performed below the knee frequency.

18. The device of claim 16, wherein the translating is logarithmic.

19. The device of claim 11, wherein the filter includes a high pass filter.

20. The device of claim 11, wherein the filter includes a high bandpass filter.

* * * * *